US009280859B2

(12) United States Patent
Itatsu et al.

(10) Patent No.: US 9,280,859 B2
(45) Date of Patent: Mar. 8, 2016

(54) ENHANCED VEHICLE ONBOARD DIAGNOSTIC SYSTEM AND METHOD

(71) Applicant: Toyota Motor Engineering & Manufacturing North America, Inc., Erlanger, KY (US)

(72) Inventors: Ryuji Itatsu, Torrance, CA (US); Alessandro Concas, Redondo Beach, CA (US); Francisco J. Lopez, Inglewood, CA (US); Dante T Boutell, Manhattan Beach, CA (US); Takashi Nakamura, Torrance, CA (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 13/646,928

(22) Filed: Oct. 8, 2012

(65) Prior Publication Data

US 2014/0100738 A1 Apr. 10, 2014

(51) Int. Cl.
*G07C 5/08* (2006.01)

(52) U.S. Cl.
CPC ..... *G07C 5/0825* (2013.01); *G07C 5/0808* (2013.01)

(58) Field of Classification Search
CPC ..... G07C 5/0825; G07C 5/0808
USPC ..... 701/33.4
See application file for complete search history.

(56) References Cited

U.S. PATENT DOCUMENTS

| | | | | | |
|---|---|---|---|---|---|
| 5,802,545 | A * | 9/1998 | Coverdill | 701/33.4 |
| 5,862,500 | A * | 1/1999 | Goodwin | 701/32.5 |
| 5,957,986 | A * | 9/1999 | Coverdill | 701/33.4 |
| 6,088,636 | A * | 7/2000 | Chigumira et al. | 701/26 |
| 6,111,498 | A * | 8/2000 | Jobes et al. | 340/438 |
| 6,141,609 | A * | 10/2000 | Herdeg et al. | 701/521 |
| 6,226,577 | B1 * | 5/2001 | Yeo | 701/29.6 |
| 6,289,332 | B2 * | 9/2001 | Menig et al. | 180/167 |
| 6,421,590 | B2 * | 7/2002 | Thibault | 701/29.6 |
| 6,629,029 | B1 * | 9/2003 | Giles | 701/31.4 |
| 6,832,141 | B2 * | 12/2004 | Skeen et al. | 701/31.4 |
| 6,847,870 | B2 * | 1/2005 | Amagasa | 701/29.1 |
| 7,020,546 | B2 * | 3/2006 | Nagai et al. | 701/33.4 |
| 7,116,216 | B2 * | 10/2006 | Andreasen et al. | 340/438 |
| RE39,619 | E * | 5/2007 | Andreasen et al. | 701/29.6 |
| 7,349,825 | B1 * | 3/2008 | Williams et al. | 702/182 |
| 7,739,562 | B2 * | 6/2010 | Cases et al. | 714/718 |
| 7,853,375 | B2 * | 12/2010 | Tuff | 701/32.6 |
| 8,019,501 | B2 * | 9/2011 | Breed | 701/31.9 |
| 8,180,522 | B2 * | 5/2012 | Tuff | 701/33.4 |

(Continued)

OTHER PUBLICATIONS

Prius Hybrid Manual, Section 1-1 Hybrid System features, pp. 30-57.

(Continued)

*Primary Examiner* — Fadey Jabr
*Assistant Examiner* — Yazan A Soofi
(74) *Attorney, Agent, or Firm* — Christopher G. Darrow; Darrow Mustafa PC

(57) ABSTRACT

The invention includes methods and devices for an improved onboard vehicle diagnostic system. The methods and devices provide for more detailed information and presentation of diagnostic and vehicle performance data for a user. In one example, real time diagnostic and trip system performance data is gathered and displayed relative to time for improved understanding of vehicle performance and operation by a user.

6 Claims, 7 Drawing Sheets

(56) References Cited

U.S. PATENT DOCUMENTS

| | | | | |
|---|---|---|---|---|
| 8,285,437 | B2 * | 10/2012 | Kubota et al. | 701/29.4 |
| 8,306,687 | B2 * | 11/2012 | Chen | 701/31.5 |
| 8,311,858 | B2 * | 11/2012 | Everett et al. | 705/4 |
| 8,370,018 | B2 * | 2/2013 | Andreasen et al. | 701/31.6 |
| 8,831,922 | B2 * | 9/2014 | Sakakibara et al. | 703/8 |
| 2002/0016655 | A1 * | 2/2002 | Joao | 701/35 |
| 2005/0131595 | A1 | 6/2005 | Luskin et al. | |
| 2005/0192727 | A1 * | 9/2005 | Shostak et al. | 701/37 |
| 2006/0284839 | A1 * | 12/2006 | Breed et al. | 345/156 |
| 2008/0086240 | A1 * | 4/2008 | Breed | 701/1 |
| 2008/0228343 | A1 * | 9/2008 | Yoshizawa | 701/30 |
| 2009/0027056 | A1 * | 1/2009 | Huang et al. | 324/439 |
| 2012/0053759 | A1 * | 3/2012 | Lowrey et al. | 701/2 |
| 2013/0151065 | A1 * | 6/2013 | Ricci | 701/31.4 |
| 2013/0184929 | A1 * | 7/2013 | Salman et al. | 701/31.5 |

OTHER PUBLICATIONS

Screenshots of BMW display, printed from http://www.michaelwoodfordmotorsport.com/cms/index.php/ecu-remapping/diesel-particulate-filter-removal-dpf-delete and http://sandiegobmw.wordpress.com/category/bmw-service/.

BMW, Owner's Manual for 2012 7 Series, Online Edition 2011, Munich Germany in 299 pages.

* cited by examiner

FIG. 4
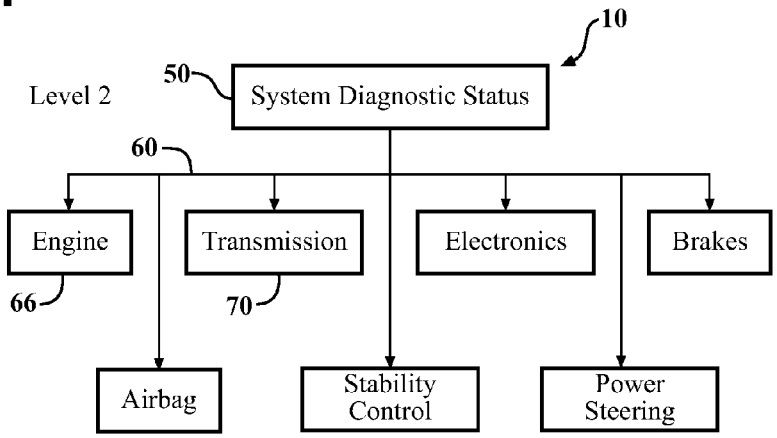
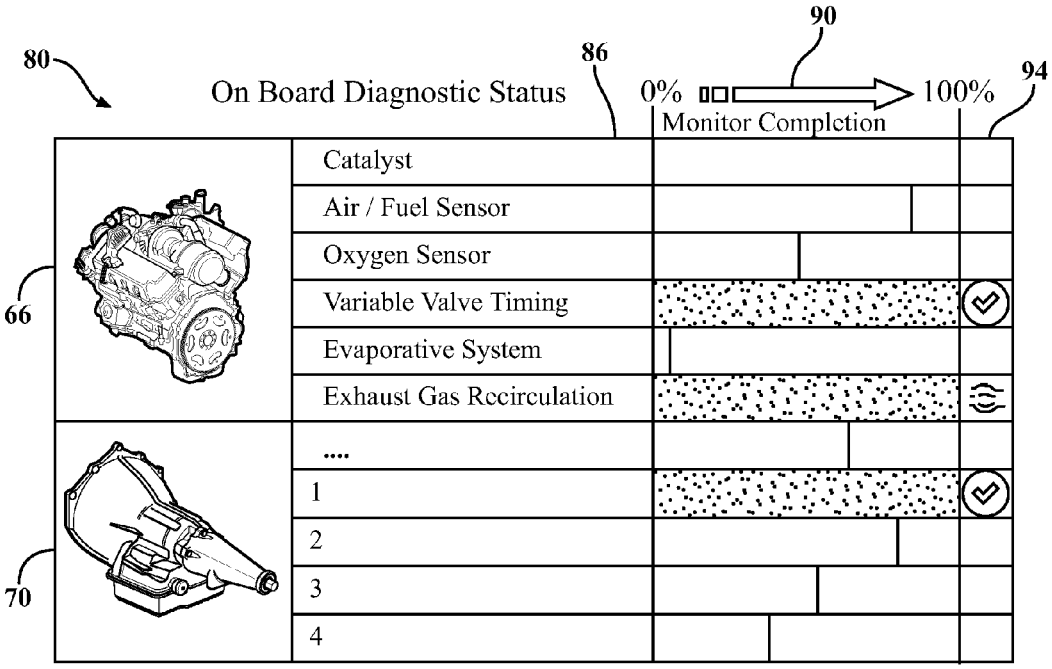
FIG. 5

ENHANCED VEHICLE ONBOARD DIAGNOSTIC SYSTEM AND METHOD

TECHNICAL FIELD

The invention generally pertains to the field of monitoring systems in passenger vehicle.

BACKGROUND

Modern passenger vehicles have become sophisticated and complex machines having hundreds of individual systems and subsystems which are interconnected and function to make the vehicle operate as designed. Many of these systems are hidden away in the engine compartment or positioned underside of the vehicle, out of sight of users and even maintenance technicians without disassembling portions of the vehicle.

Vehicular diagnostic and performance devices, for example, onboard diagnostic systems (OBD), have been employed to electronically monitor numerous vehicle systems during operation of the vehicle and alert the user to a malfunction of the monitored systems. The basic OBD is limited to illuminating a malfunction indication light (MIL) on the instrument panel or cluster to alert a user to a problem. Although helpful to alert the user to a malfunction, the MIL provides little information to the user as to the cause or severity of the malfunction.

More sophisticated OBDs can monitor more vehicular systems and provide more information to a user, for example, using internet or cellular communications to advise users of the need for service and advise of the nearest service facility.

Still, modern systems have disadvantages in many areas, for example, only providing an alert when a malfunction occurs rather than proactively monitoring the deterioration or remaining useful life of systems and components to better advise the user of anticipated maintenance to avoid disruptions in the use of the vehicle.

Environmentally conscious users and auto enthusiasts desire additional information about the condition and performance of their vehicles to avoid problems and optimize the performance of the vehicle and their driving habits. With the increased access to information on the world through the internet, users want up to the minute information and data about the operation and performance of their vehicles.

Thus, there is a need for increased or enhanced vehicular diagnostic systems to monitor vehicle systems and to advise or report the current and historic diagnostic and performance information to users. Such systems must be integrated into the vehicle and be easy to implement and use by users.

BRIEF SUMMARY

The present invention provides an enhanced vehicular onboard diagnostic system for monitoring and reporting information to users. In a preferred example, the invention continuously monitors numerous vehicular systems and components and provides positive feedback to a driver/user in the form of a visual display of the current status or condition of the respective systems in real time providing up to the minute information of the systems and vehicle performance. In one example, the positive feedback aspect provides information or data about systems or components that may be malfunctioning, but also and selectively the status of, or confirmation of, vehicle systems that are functioning properly providing the user broader information about the condition and operation of the vehicle.

In one example, the diagnostic system includes a diagnostic device which monitors and displays the diagnostic reporting status of numerous sensors throughout the vehicle and on completion of predetermined sensor reporting requirements, provides a visual display of normal operation or a malfunction of the individual monitored system.

In another example, the diagnostic system receives sensor information and calculates the deterioration or remaining useful life of individual vehicle systems, for example, components that are subject to wear and have recommended maintenance or replacement schedules established by the vehicle manufacturer. A user is provided a visual display of such useful life through selection of such diagnostic data through a visual display or other onboard device.

In another example, the diagnostic system provides a user the ability to select real time information on the status and performance of the monitored vehicle systems or trip system performance which includes such diagnostic or performance data based on a time period established by the user, for example, information and performance over a defined vehicle trip or time period.

Other examples and applications of the present invention will become apparent to those skilled in the art when the following description and examples of practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 4 is a schematic flow chart of an example of a detailed level 2 of diagnostic information selectively provided to a user on a display device;

FIG. 5 is an example of a visual display graphic for the diagnostic information of FIG. 4;

DETAILED DESCRIPTION OF EMBODIMENTS OF THE INVENTION

Figure 1:
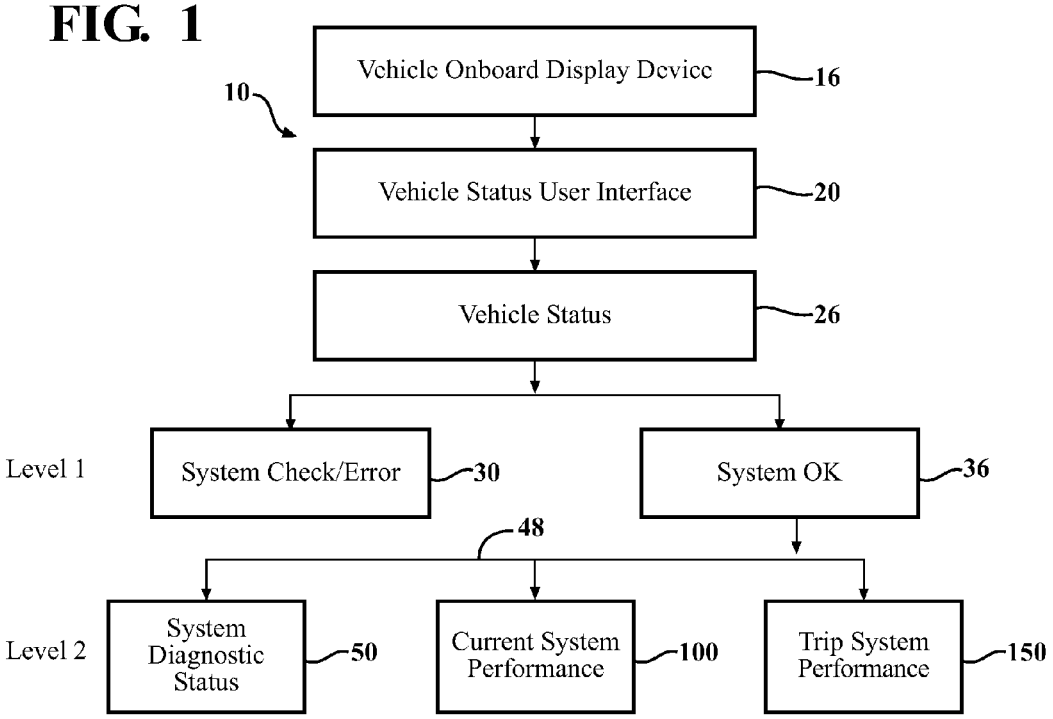
FIG. 1 is a schematic flow chart of one example of the invention.

Examples of a device and methods for an enhanced vehicle onboard diagnostic systems are illustrated in FIGS. 1-10. Referring to FIG. 1, a schematic flow chart showing an example of a monitoring and data display structure of the enhanced vehicle onboard diagnostic system 10 is shown is shown.

In the example, the system 10 includes an onboard vehicle display device 16, for example a visual electronic display screen. The display device 16 preferably includes a high resolution electronic display screen for selected visual display of vehicle diagnostic and performance data for a user described below. The display device 16 is preferably included in the instrument panel of a vehicle, for example, a portion of the vehicle center counsel within easy view and physical access by a user. The display device 16 can be integrated into the interior styling of the vehicle, but may be a separate device that is selectively placed in electronic communication with the vehicle diagnostic system 10 as further described below. Other display devices, configurations and positions relative to a vehicle known by those skilled in the art may be used or employed in system 10.

In the example, the visual display device 16 includes a vehicle status user interface 20 for communication of the diagnostic data to a user. In a preferred example, the interface includes features for the user to make selections of the data desired to be displayed and input information for use by the invention 10 to monitor and display desired information. The interface 20 may include a touch sensitive screen allowing the user to select menu options through touching one or more portions of the display screen which activate the selected function. The interface may alternatively be responsive through other user actions, for example, voice activation to choose the selected menu option or activate other features offered by system 10.

Figure 3:
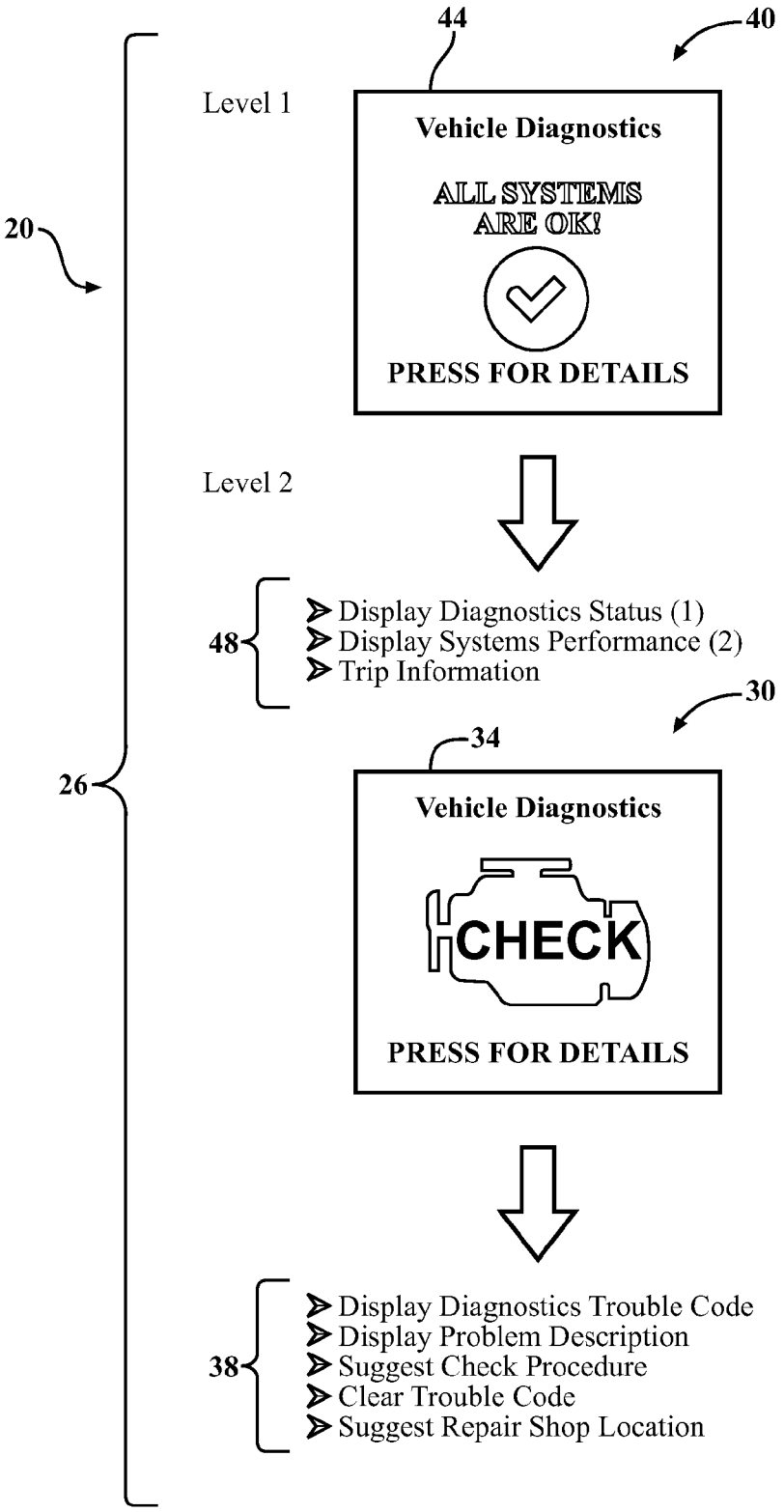
FIG. 3 are graphic examples of a high level or level 1 of diagnostic information provided to a user on a display device.

In one example of the interface 20, a visual display or graphic of a menu option to display the vehicle system status 26 is displayed for a user. In the example illustrated, a visual display menu may include a high level or level 1 of information for a user of the vehicle system status. Referring to FIGS. 1 and 3, the level 1 display may include two alternative graphics, a system error or malfunction 30 or a system normal operation graphic 40. In the graphic 40, the system 10 provides a visual indication that all monitored diagnostic systems are performing properly or within acceptable ranges. Although selectable by the user as to what is displayed on the display 16, graphic 40 is preferably a default on the level 1 display.

As best seen in FIG. 3, in the event of a vehicle system malfunction or error in system 10, a system check or alert graphic 30 may be displayed on display 16 to alert the user. In the example graphic 30. a specific system check graphic or symbol 34, for example an engine, to provide a general indication of the system to alert the user. In the example, the interface 20 preferably provides a menu 38 for the user to select and have displayed additional information about the malfunction, for example, the options shown in FIG. 3. On selection of the additional menu options, the system 10 provides visual information about the displayed alert. Other detailed menu options 38 known by those skilled in the art may be included.

In the example, when the user has obtained the desired information about the check system alert, a specific trouble code may be selected which returns the user to the graphic 40 for selection of other diagnostic information available by system 10. It is understood that graphic 40 may include that a system alert is still present through visual display of a symbol or other indication (not shown) reminder the user of an ongoing alert.

Graphic 40 preferably provides a symbol 44, for example a green check, when all monitored systems are functioning properly. Similar to graphic 30, an additional menu 48 may selectively be accessed or initiated by a user for additional diagnostic and performance information to a user. Other symbols or indicators 44 known by those skilled in the art may be used. It is understood that graphic or symbol 40 may alternately or also include an audible alert through speakers in the vehicle.

As best seen in the examples in FIGS. 1 and 3, on selection by the user of additional information from graphic 40, a user is preferably presented with a menu 48 including three options of more detailed, level 2, vehicle system diagnostic and performance information to be displayed on display 16. In the example, menu 48 includes level 2 system diagnostic status 50, current system performance 100 and trip system performance 150. In the example, one or more of the level 2 options 50, 100 and 150 include calculations or displays relative to time tracked or recorded by system 10 as further described below. It is understood that additional or optional menus or selection other than 50, 100 and 150 known by those skilled in the art may be used.

Referring to FIG. 4, an example of level 2 system diagnostic status 50 information or data menu is illustrated. In the example, menu 50 provides a user detailed information on the vehicle primary systems 60 which are monitored by a diagnostic device 210, which can be in the form of the vehicle's resident and onboard diagnostic system (OBD), which includes numerous sensors which monitor the vehicle's primary systems and components further described and illustrated below. It is contemplated that the diagnostic device 210 may include a diagnostic device or supplemental module (not shown) other than the vehicle's resident OBD.

In the FIG. 4 example, the system diagnostic status 50 option or menu accessible through display 16 interface 20 includes information on many, if not all, of the vehicle's primary systems including the engine 66, transmission 70 and other systems illustrated. As shown in FIG. 5, each of these primary systems, for example 66 and 70, each may include several vehicle sub-systems or components that are also monitored by the OBD 210 and data may be presented to a user for detailed information or data on each of the primary, subsystems and components in the vehicle. It is understood that additional primary systems other than those illustrated in FIG. 4 and described herein known by those skilled in the art may be monitored and displayed. The primary, subsystems and components that are monitored by the vehicle OBD 210 may vary depending on the original equipment options or level of luxury of the vehicle. For example, more expensive vehicles may monitor more vehicle systems that are included in system 10 than less expensive vehicle models.

In the example shown in FIG. 5, system 10 and system status diagnostic function 50 may include a visual display or graphic 80 which displays the reporting status of numerous sensors on subsystems and components for primary systems, for example 66 and 70, monitored by the OBD 210. It is known in conventional OBDs that all systems sensors do not continuously report data to the OBD, but rather only report the status or data when certain conditions are met. For example, an wideband exhaust gas sensor may not report a status or data until the vehicle engine has been operating for more than a predetermined number of minutes to obtain an accurate baseline of data following startup of the engine. Other systems have different conditions that need to be met as those known by those skilled in the art. Prior diagnostic and display systems do not provide the reporting status of such monitored systems which may leave the user concerned as to whether that particular primary or subsystem is operating properly or whether there is a problem with the monitoring system itself.

In the FIG. 5 example, the system 10 provides a visual display graphic 80 for the user which includes a listing of the subsystems and components that are monitored by the diagnostic device 210, preferably the vehicle OBD 210. The graphic 80 identifies each of the monitored components and provides a visual status or progress chart to advise a user the reporting status of the monitored component and whether the preconditions have been met. In the illustrated example, the variable valve timing reporting preconditions have all been met which shows 100%, but only certain of the catalyst reporting preconditions have been met (about 40%). The exemplary graphic 80 provides the monitor completion 90 for each of the identified components.

The example graphic 80 in FIG. 5 further includes a diagnostic status graphic 94 which, when all of the reporting preconditions are satisfied (100%), a status of whether the monitored listed system, subsystem or component is operating normally (for example the variable valve timing) or whether there is a malfunction or error (the exhaust gas recirculation) as generally illustrated. The graphic 80 provides a user timely information on the reporting status of the numerous OBD sensors in the vehicle as well as detail as to which system are reporting data and the progress of the other systems based on the preconditions for reporting. It is understood that alternate graphics 80 for displaying such information, as well as the identified vehicle system components known by those skilled in the art may be used and displayed.

Figure 6:
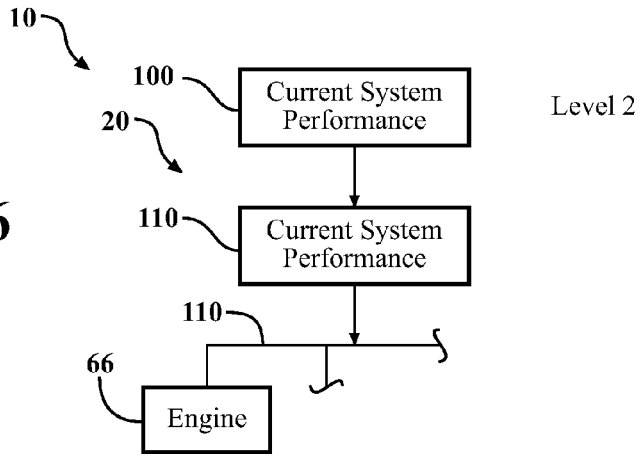
FIG. 6 is a schematic flow chart of an example of a detailed level 2 of vehicle system performance selectively provided to a user on a display device.
Figure 7:
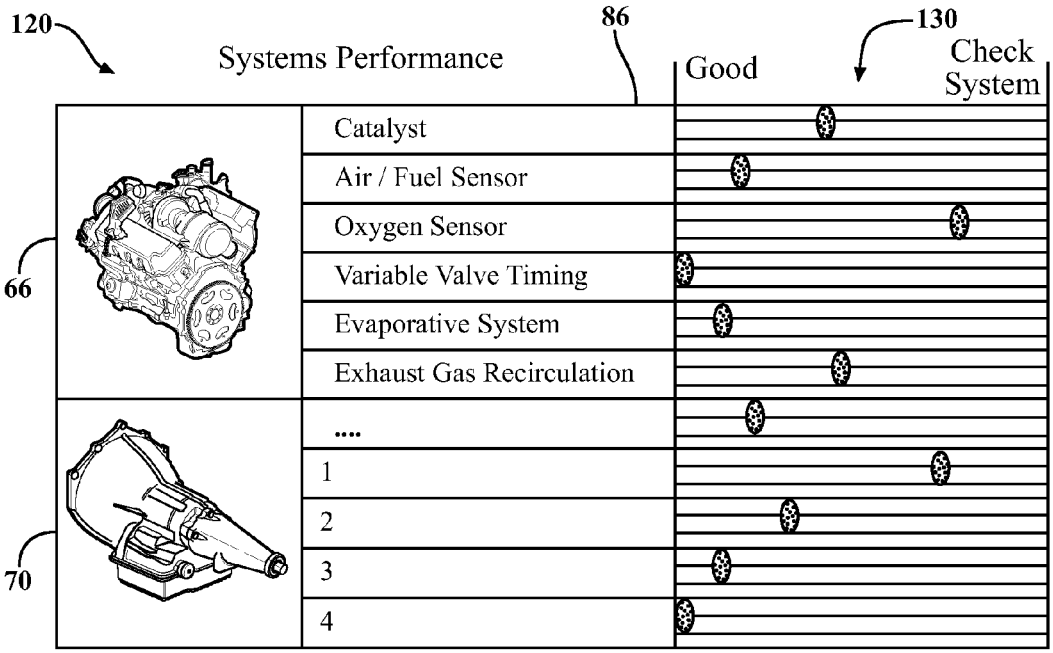
FIG. 7 is an example of a visual display graphic for the system performance of FIG. 6.

Referring to FIGS. 6 and 7, an example of system 10 diagnostic system display of current system performance 100 is shown. In the example, when a user desires to review more detailed information than presented in level 1 system check 36 (FIG. 1), the current system performance 100 can be selected from display 16 through user interface 20. As described, this can be done through numerous ways known by those skilled in the art, for example, through a touch screen on display 16, voice commands and others.

One example of more detailed or level 2 system performance is the remaining useful life or deterioration or wear of systems, subsystems and components monitored by the OBD 210. In an example, on visual display of a current system performance menu, a user can select a display of more detailed current system status and functionality 110. In the example, the system 10 calculates the deterioration/wear or remaining useful life of, for example, the primary vehicle systems, subsystems and components described above that are being monitored by the OBD 210.

Referring to FIG. 7, a graphic is depicted for displaying the wear or remaining useful life of primary systems 66 and 70 and the respective subsystems and components 86 are identified in a useful life graphic 130 as generally shown. In the example, a linear graph or range is presented from "Good", which indicates a new or barely deteriorated state of a subsystem or component to "Check System," which advises that it is time for maintenance, service and/or replacement of the monitored device. This allows the user to foresee and anticipate recommended service on primary vehicle systems, subsystems and components versus being surprised by an alert in conventional diagnostic systems when the subsystem is worn or required service which may not be convenient for the user and interrupt use of the vehicle.

Examples of sensors that may be used for vehicle systems, subsystems and components other than those illustrated include: air/fuel ratio, oxygen, engine coolant temperature, intake air temperature, crankshaft position, intake air flow, air injection pressure, accelerator pedal position, shift position. Examples of OBD 210 monitored systems, subsystems and components other than those illustrated may include: temperatures for engine coolant, engine oil, intake air, and catalyst bed; speeds for the vehicle and engine and others including intake air volume, engine load, air/fuel ratio, fuel consumption, atmospheric pressure, catalyst oxygen storage amount, trip duration, trip distance, spark timing, valve timing, battery voltage and misfire count. It is understood that many additional sensors and diagnostic and performance data monitored by the diagnostic device 210, such as the resident OBD 210, and other systems known by those skilled in the art may be included and used by system 10 as described herein.

The calculation of wear and remaining useful life by system 10 can be done in different ways depending on the vehicle system, subsystem or component that is being monitored. In some of these calculations, a time period is recorded and tracked by system 10 for use by system 10 as further described below. For example, prior diagnostic data can be compared to present diagnostic data for the same component and degradation of performance or other factors can be used to estimate the deterioration of performance or other factor over that period of time. This can then be compared to stored data, tables, maintenance schedules or other information in the ECU to determine the wear or degradation that has occurred for that system or component. Alternately, other diagnostic data and vehicle information can be combined and used to estimate the wear and provide a visual graphic 120 for the user to see. For example, the vehicle mileage or time of operation can be used to estimate the wear on the vehicle brakes, fuel and oil/lubrication system components. These comparisons and calculations can be carried out by a processor in the ECU in combination with software and data (not shown) stored onboard in the ECU memory and in electronic communication with the diagnostic device 210, such as the resident OBD 210, as described further below. Other devices and processes known by those skilled in the art may be used. It is understood that different data and graphics other than that shown in FIG. 7 may be used to visually display this information to a user through display 16 and interface 20.

Figure 8:
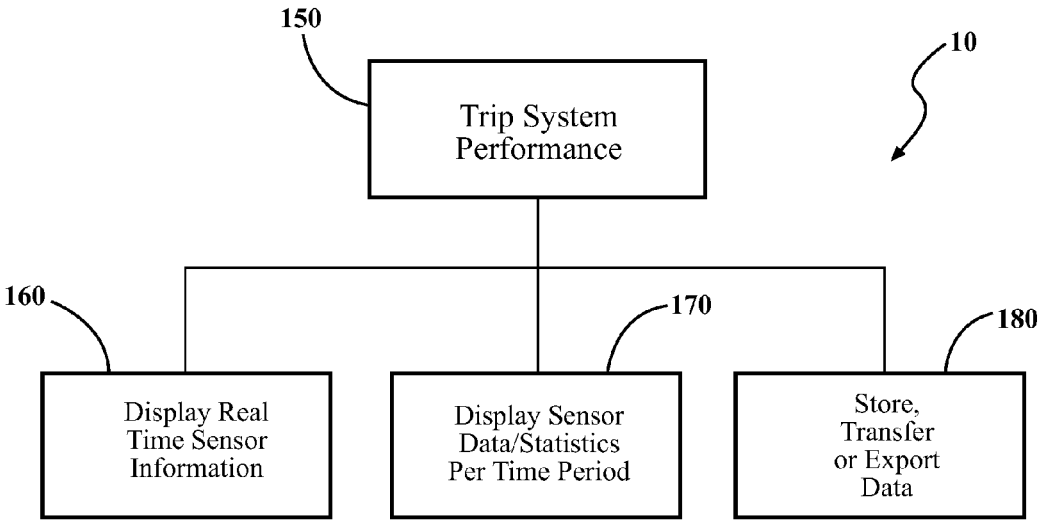
FIG. 8 is a schematic flow chart of an example of detailed level 2 of a vehicle trip system performance selectively provided to a user on a display device.

Referring to FIG. 8, examples of diagnostic data and visual display of trip system performance 150 (FIG. 1) are illustrated. In an example, a user can select and be presented with more detailed, level 2, vehicle diagnostic and performance data either in real time or for a specified period or vehicle trip, for example, a vacation or even an everyday destination. Such advanced and detailed diagnostic and performance data over a definitive period can aid a user in better understanding how the vehicle performs under certain conditions as well as better inform the user of driving habits that improve or degrade vehicle performance to change or improve driver habits for more efficient and economical operation of the vehicle.

In the example, a user may select to receive and have displayed trip system performance 150 through selection of the menu 48 through graphic 40 as best seen in FIGS. 1 and 3. In one but not an exclusive example, three variations of trip system performance 160, 170 and 180 based on a time period tracked by system 10 may be presented through a graphic in user interface 20.

In the FIG. 8 example, real time diagnostic and performance data for the OBD 210 sensors can be selected by the user. This selection requests system 10 to determine or organize the present/real time status and diagnostic information from the OBD 210 system. The time period used would be substantially instantaneous or a snapshot of the present data being monitored and collected by the OBD 210. This real time diagnostic and performance data for the above-noted sensors and OBD 210 monitored data can be presented and displayed in many forms on the display 16 and through user interface 20. This additional level of detail, on a real or substantially real time basis, is useful to a user to understand the present operational and performance of the vehicle's primary systems, subsystems and components monitored by the vehicle's OBD. This is an improvement over prior systems which typically only provided alert lights or symbols when a malfunction occurred or only limited information as to the cause, nature or severity of the malfunction or error.

In the FIG. 8 example, a user may select to receive and have displayed or communicated diagnostic and performance data 170 for a selected time period, for example, a trip to the store or between destinations on a vacation trip. It is contemplated that the user interface 20 may include prompts or inputs (not shown) for a user to manually set a beginning and ending time for the time period or may set a default period starting time. For example, the beginning time may be on the vehicle system start up. For example, for a conventional internal combustion engine vehicle, this new time period may begin each time the vehicle is restarted (ignition system starts) and ends when the vehicle is turned off. In another example of a vehicle system start up for alternatively powered vehicles, for example hybrids or electric vehicles, the vehicle system start up new time period may begin when the propulsion system is in a ready or operable state or condition. Similarly, the time period stop or ending time may be when the vehicle engine or propulsion system is turned off or placed in a non-operating or non-propulsion generating state. It is understood that such time period start and end times may also be preprogrammed or set as defaults and be set by other events as known by those skilled in the art.

The display and communication of trip system performance as described above on a display device 16 and user interface 20 can take many forms. In one display graphic (not shown), the diagnostic and performance data is displayed relative to time so that a user can see how the diagnostics or performance of one, or many, of the monitored vehicle systems, subsystems and components are performing over time during the time period. In one example, the trip system performance data 170 would automatically be displayed on the display device 16 at the end of the time period. For example, if the trip system time period ends with shut off of the vehicle, the trip system performance data 170 may be displayed for a short period of time to provide the user the data for the immediately prior time period. Alternately, if the user sets the time period, for example every hour on an extended trip, the performance data may be displayed on the visual display 16 for a short time following ending of the period. This again provides a user more detailed and useful information to better inform the user how the vehicle is performing and better inform the user of driving habits that may be improving or degrading vehicle performance over the time period for increased vehicle performance and efficiency. Other devices, methods and processes for calculating and displaying trip system performance 170 known by those skilled in the art may be used.

Referring to FIG. 8, the trip system performance process may also provide options and methods to transfer or export time-based diagnostic and performance data 180 to other onboard vehicle devices as well as remote devices. These remote devices may include "smart devices" including smart phones, tablets, permanent and portable navigation/GPS devices, computers and other electronic devices known by those skilled in the art. These devices can be typically used with the vehicle or can be remote, for example, sending vehicle system malfunction information to the nearest service facility. Likewise, system 10 may send inquiries and/or receive data from remote sources, for example, the location and contact information of the nearest authorized service station. In one example, where a malfunction occurs and prompt service or repair is recommended, system 10 can export data to the nearest identified authorized service center or other facility. In the example, the service center can be alerted of the malfunction, proactively contact the user, communicate with system 10 to provide instructions or directions and/or prepare to remedy the malfunction. In one example, the vehicle operator can schedule the next available service appointment available with the service center through the user display and interface 16. The methods and means for sending and receiving electronic information and data from the vehicle to remote locations are known by those skilled in the art.

Figure 9:
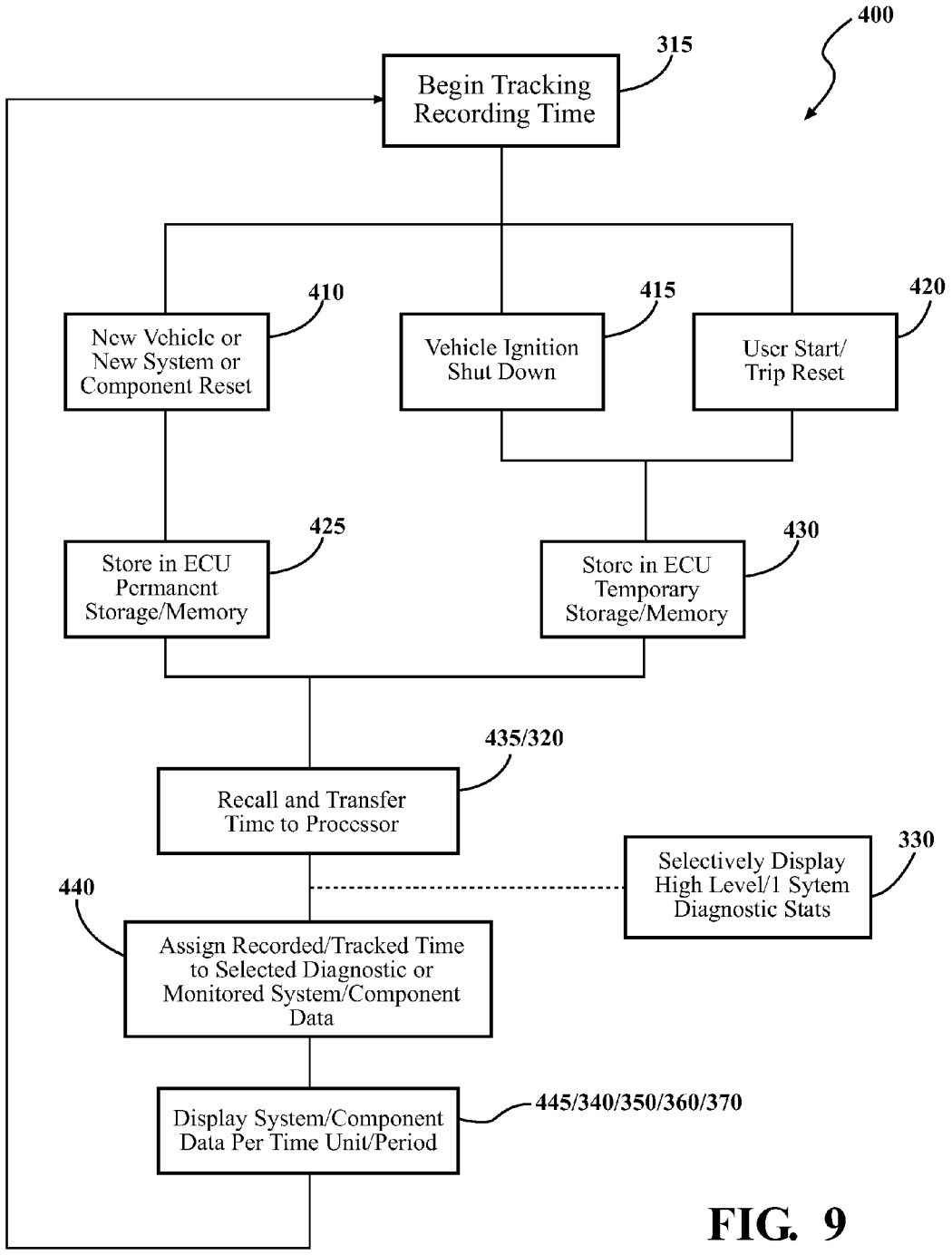
FIG. 9 is a schematic flow chart of an example of a method for tracking and recording time for use with vehicular diagnostic and performance data for selected display to a vehicle user.

Referring to FIG. 9, an example of a process 400 to track, record and calculate a time and time period for use in system 10 and trip system performance 150 is shown. In the example system 10 begins with a step 315 (see FIG. 10) tracking or recording time with an internal clock or other known device or method. This can simply access a resident time recording device in the vehicle, for example, used for a vehicle interior clock, or may be a separate device. Tracking or recordation of time can be ongoing and does not terminate or stop upon shutting off the vehicle engine.

Process steps 410, 415 and 420 provide examples of methods or points to begin the time period over which, for example, trip system performance 150 described above is calculated and/or organized for presentation to the user. In the example, step 410 includes time period beginning points that are stored in the permanent vehicle memory step 425 in the ECU. This may be when the vehicle is new or a component or system is replaced or serviced and its useful life is reset to 100%.

In exemplary step 415, the time period may be set or tripped when the vehicle's ignition system is activated on vehicle system start up, for example, engine ignition or on alternative powered vehicles, the propulsion system is in a ready or operational condition. As described above, alternate start of time and stop of time periods based on other vehicle processes or functions known by those skilled in the art may be used. In step 420, the user may manually set or reset a beginning of the time period through display 16 interface 20. These time period starting points may be stored in a temporary vehicle memory storage device step 430 and are cleared when the vehicle is shut off or powered down.

In step 435, on selection by a user of trip system performance data 150 from the user interface, the recorded time and associated monitored diagnostic device, such as the OBD, data are recalled and transferred to the ECU processor wherein necessary comparisons, calculations and other processes 440 are carried out depending on the data and the predetermined visual display 445 of the time relative data on display 16 described in the many above examples. It is understood that additional process steps, and in different order of steps, may be used as known by those skilled in the art.

Figure 10:
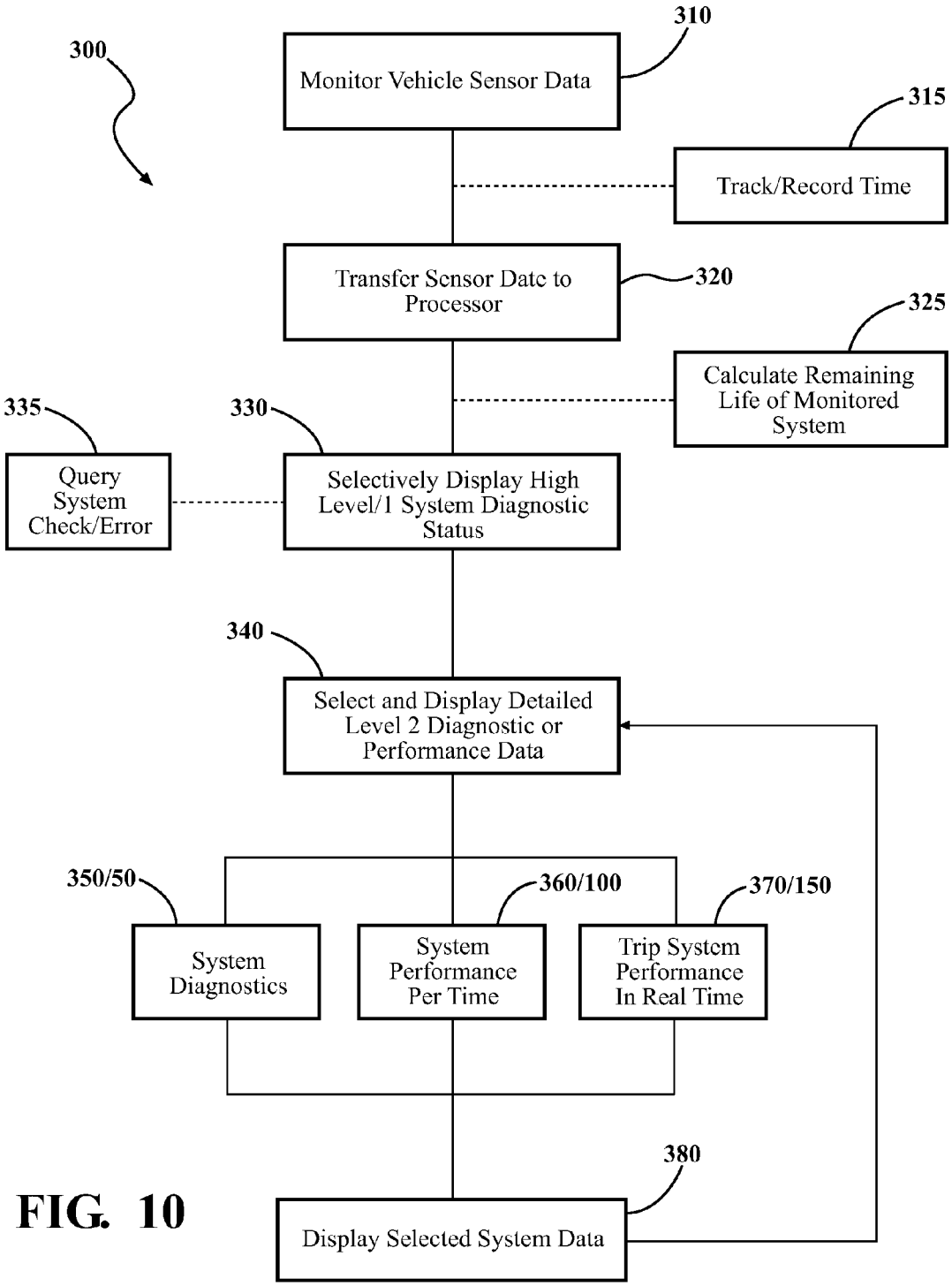
FIG. 10 is a schematic flow chart of an example of a method of displaying vehicular diagnostic and performance information to a user.

Referring to FIG. 10, an example of a process 300 for enhanced onboard diagnostic system is illustrated. In the example, step 310 includes monitoring diagnostic and performance data of vehicle systems, subsystems and components as described above. It is contemplated that most, if not all, of the monitored systems will be done by the vehicle's resident OBD, but other data tracked and recorded by the diagnostic device 210 for vehicle systems other than the OBD may be used as known by those skilled in the art.

In alternate step 315, the time and time period may be tracked and recorded as described above.

In step 320, the diagnostic device 210, such as the OBD 210 and/or other system sensor data is transferred to a processor in the vehicle ECU for comparison, calculation and manipulation of the data depending on the data and diagnostic information automatically generated by system 10 or as selected by the user. It is understood that the processor may be separate from the vehicle ECU, for example, if system 10 were a self-contained, stand-alone device that is installed in the vehicle and placed in communication with the vehicle's resident ECU or other communication system.

In alternate step 325, a calculation of vehicle system, subsystem and component wear or remaining useful life as described above may be made for use in system 10.

In step 330, display on the display device 16 of high level, or level 1, diagnostic and system performance data as described above is made (FIG. 3). This may include a system normal graphic 40 or a check or alert graphic 30. If a check system alert is displayed, an alternate step 335 to present additional menus and data for the malfunction may be displayed as described above.

In step 340, if the user desires more detailed level 2 information as described above, exemplary menu 48 (FIGS. 1 and 3) are selected by the user through the user interface 20.

In the examples described above, steps 350, 360 and 370 allow a user to select the level 2 system diagnostics, system performance and trip system performance as described above.

In step 380, the diagnostic and performance data is visually displayed or otherwise communicated to the user through display device 16. On satisfaction of the displayed information by the user, the user can return to the high level, level 1, diagnostic and performance detail in step 330 or select other data to be displayed. It is understood that additional process steps and in different order known by those skilled in the art may be used.

Figure 2:
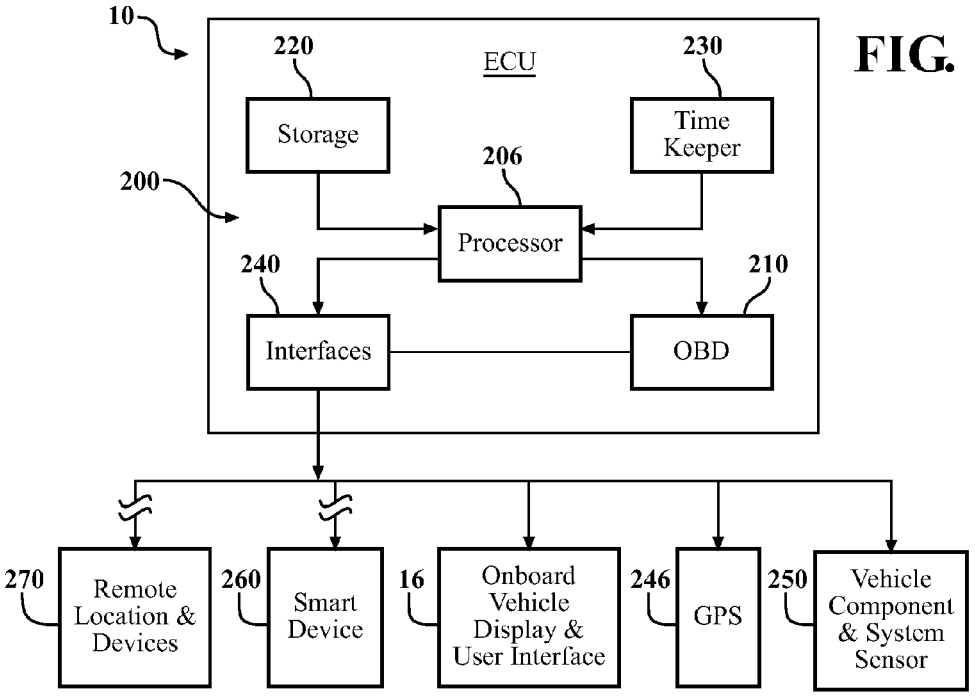
FIG. 2 is a schematic drawing of an example of the invention.

Referring to FIG. 2, an example of a device 200 used for the system 10 and the many process examples described above is illustrated. In one example, system 10 is resident in the vehicle's existing electronic control unit (ECU). In the example, no additional hardware is needed and system 10 is operable through additional software that is stored on the ECU memory or storage device 220 and is executable through connection to a processor 206.

As described, the principal, but not necessarily sole monitoring system used by system 10 is the diagnostic device 210, such as the vehicle's resident onboard diagnostic system (OBD) 210, which is typically part of the ECU as generally illustrated. The diagnostic device 210, in the form of the resident OBD 210, includes hardware, software, sensors and other components described herein and as known by those skilled in the art. As described, system 10 further includes a time keeping component 230 which, as described may be existing in the vehicle ECU for other purposes. The system 10 software would simply obtain the needed time data from the existing system for the functions and purposes described above.

As shown, the processor 206, diagnostic device 210, storage 220 and time keeper 230 are in electronic communication with one another and with one or more ECU interfaces 240 for communication and transfer of data with devices exterior to the ECU. In the example, the OBD 210 is in communication with numerous sensors and data gathering devices which are connected to or otherwise in communication with respective vehicle systems, subsystems and components as described above. The system 10 acts on the signals and data from the OBD and possibly other data gathering and generating devices in the manners described above.

Examples of devices which are connected to the one or more interfaces are the OBD sensors 250, a global positioning system (GPS) device 246 and the vehicle's display device 16 which displays the diagnostic and performance data described above.

Also shown are smart devices 260 which can be connected directly to the vehicle, for example a smart phone, tablet, laptop or other portable or mobile electronic devices, or may be remote and can communicate with system 10 to send and receive information to system 10 as described above.

Other remote devices 270, for example, desktop computers at service and repair facilities, may be placed in communication with system 10 as well. It is understood that additional hardware, components and other devices may be added or substituted for the general illustrations shown in FIG. 2 known by those skilled in the art.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for providing vehicle system diagnostic data to a vehicle user, the method comprising:

monitoring a characteristic of a plurality of onboard mechanical vehicle systems defining a plurality of diagnostic data, the plurality of onboard mechanical vehicle systems characteristics including at least one of an air/fuel sensor operation, an oxygen sensor operation, variable valve time operation, an evaporative system operation, and an exhaust gas recirculation system operation, each onboard mechanical vehicle system having a useful life subject to deterioration before replacement or maintenance;

recording time having a starting time and an ending time defining a time period;

assigning at least a portion of the time period to at least one of the diagnostic data defining a time performance data;

selectively displaying diagnostic data to a user through a user visual display;

selectively displaying time performance data on the user visual display including:

determining, by a processor receiving the diagnostic data, a system performance of one of the onboard mechanical vehicle systems by calculating a present useful remaining life of each one of the onboard mechanical vehicle systems by comparing diagnostic data for the monitored characteristic from a present time in the time period versus diagnostic data for the monitored characteristic from a time in the time period prior to the present time and determining an amount of deterioration in the monitored characteristic; and displaying a visual graphic depicting a listing of the calculated present remaining useful life of each one of the plurality of onboard mechanical vehicle systems including displaying a range of useful life having a first point and a second point on a linear graph, the present useful life positioned between the first and the second points visualizing both the amount of deterioration and the remaining useful life of each one of the onboard mechanical vehicle systems.

2. The method of claim 1 wherein:

the monitoring of the characteristic of a plurality of onboard mechanical vehicle systems is performed by a vehicle onboard diagnostic system.

3. A method for providing vehicle system diagnostic data to a vehicle user, the method comprising:

monitoring a characteristic of a plurality of onboard mechanical vehicle systems defining a plurality of diagnostic data, the plurality of onboard mechanical vehicle systems characteristics including at least one of an air/fuel sensor operation, an oxygen sensor operation, variable valve time operation, an evaporative system operation, and an exhaust gas recirculation system operation, each onboard mechanical vehicle system having a useful life subject to deterioration before replacement or maintenance;

recording time having a starting time and an ending time defining a time period;

assigning at least a portion of the time period to at least one of the diagnostic data defining a time performance data;

selectively displaying time performance data on a user visual display by:

determining, by a processor receiving the diagnostic data, a trip system performance of each of the plurality of onboard vehicle systems by calculating the diagnostic data for a vehicle system for a predetermined portion of the time period; and displaying a visual graphic, including a linear graph, to the user visual display depicting the calculated diagnostic data for each of the plurality of onboard mechanical vehicle systems.

4. The method of claim 3 wherein the predetermined portion of the time period is short and proximate a present time defining a real time trip system performance for that onboard mechanical vehicle system.

5. The method of claim 3 wherein the predetermined portion of the time period is defined by the last in time vehicle system start up and the last in time vehicle propulsion system shut down.

6. The method of claim 3 wherein calculating the diagnostic data for the predetermined portion of the time period comprises averaging the diagnostic data for the onboard mechanical vehicle system over the predetermined time period.

* * * * *